United States Patent [19]

Smith, Jr.

[11] 4,030,857

[45] June 21, 1977

[54] PAINT PUMP FOR AIRLESS SPRAY GUNS

[75] Inventor: Gary C. Smith, Jr., Oregon, Ohio

[73] Assignee: Champion Spark Plug Company, Toledo, Ohio

[22] Filed: Oct. 29, 1975

[21] Appl. No.: 626,742

[52] U.S. Cl. ..... 417/46; 417/390

[51] Int. Cl.[2] ..... F04B 49/00

[58] Field of Search ..... 91/49, 50, 311; 417/46, 417/280, 390, 403

[56] References Cited

UNITED STATES PATENTS

| | | | |
|---|---|---|---|
| 1,566,995 | 12/1925 | Stanberwick | 417/46 |
| 2,048,736 | 7/1936 | Esser | 417/280 |
| 2,161,922 | 6/1939 | Goode | 91/50 |
| 2,593,255 | 4/1952 | Bowman | 417/390 |
| 2,605,716 | 8/1952 | Huber | 417/303 |
| 2,787,223 | 4/1957 | Sargent | 91/313 |
| 3,103,891 | 9/1963 | Fulton et al. | 417/300 |
| 3,139,830 | 7/1964 | Uhezawa | 417/311 |
| 3,164,101 | 1/1965 | Nederynon | 417/390 |
| 3,207,080 | 9/1965 | Schlosser | 417/390 |
| 3,366,066 | 1/1968 | Levey | 417/390 |

FOREIGN PATENTS OR APPLICATIONS

| | | | |
|---|---|---|---|
| 1,262,366 | 4/1961 | France | 91/49 |

*Primary Examiner*—William L. Freeh
*Attorney, Agent, or Firm*—Allen Owen

[57] ABSTRACT

This invention relates to a fluid actuated paint pump for high pressure airless spray guns and includes a novel unloading system in combination with a self-reversing fluid motor connected to a double-acting pump which supplies paint from a reservoir to an airless spray gun at a pressure which may run as high as 3500 psi.

3 Claims, 4 Drawing Figures

TOP REVERSAL-
PILOT VALVE DOWN.

BOTTOM REVERSAL-
PILOT VALVE UP.

PAINT PUMP FOR AIRLESS SPRAY GUNS

BACKGROUND OF THE INVENTION

Paint pumps for airless guns at the present time are generally mechanically, hydraulically or pneumatically driven pistons or diaphragms. Each of the driving techniques presently employed has its own problems involving pressure control of the paint to the airless gun. Release of the gun trigger in the course of painting by the operator requires that the paint pump (piston or diaphragm) be prevented from any further pumping action; otherwise, an over-pressure condition will develop.

The mechanically driven pumps heretofore known have employed paint pressure sensitive switches acting on the electric motor driver directly or indirectly through a clutch between the electric motor and the mechanical driver. The pneumatically driven pumps have employed a conventional regulator to limit the maximum pneumatic pressure available to the driver. The hydraulically driven systems heretofore have employed variable displacement pressure compensated hydraulic pumps or relief valves where all or a portion of the hydraulic fluid is metered across the valve to prevent over-pressurization.

The variable displacement pressure compensated pump is the most efficient means since at zero flow the power consumption is at a minimum. Unfortunately, such a pressure compensated system is relatively expensive compared to the constant displacement hydraulic pump with its hydraulic relief valve.

STATEMENT OF THE INVENTION

This invention, by employing an unloading valve in the hydraulic system, offers the following advantages over existing systems:

a. Power loss and heat generation in the hydraulic system is minimized by recirculating the hydraulic output unrestricted to the hydraulic reservoir.

b. The unloading system (even though it is under on-off control) by its high frequency response approaches the infinitely variable characteristics of a variable displacement pressure compensated system when the operator is demanding partial flow of paint.

c. The cost of the unloading system is approximately on the same economic level as the constant displacement hydraulic pump-relief valve system.

d. The electric motor driving the hydraulic pump is allowed to run continuously, preventing electric motor overheating due to high starting currents.

e. The unloading system allows the elimination of a heat exchanger as is required in relief valve systems.

DESCRIPTION OF A PREFERRED EMBODIMENT

Figure 1:
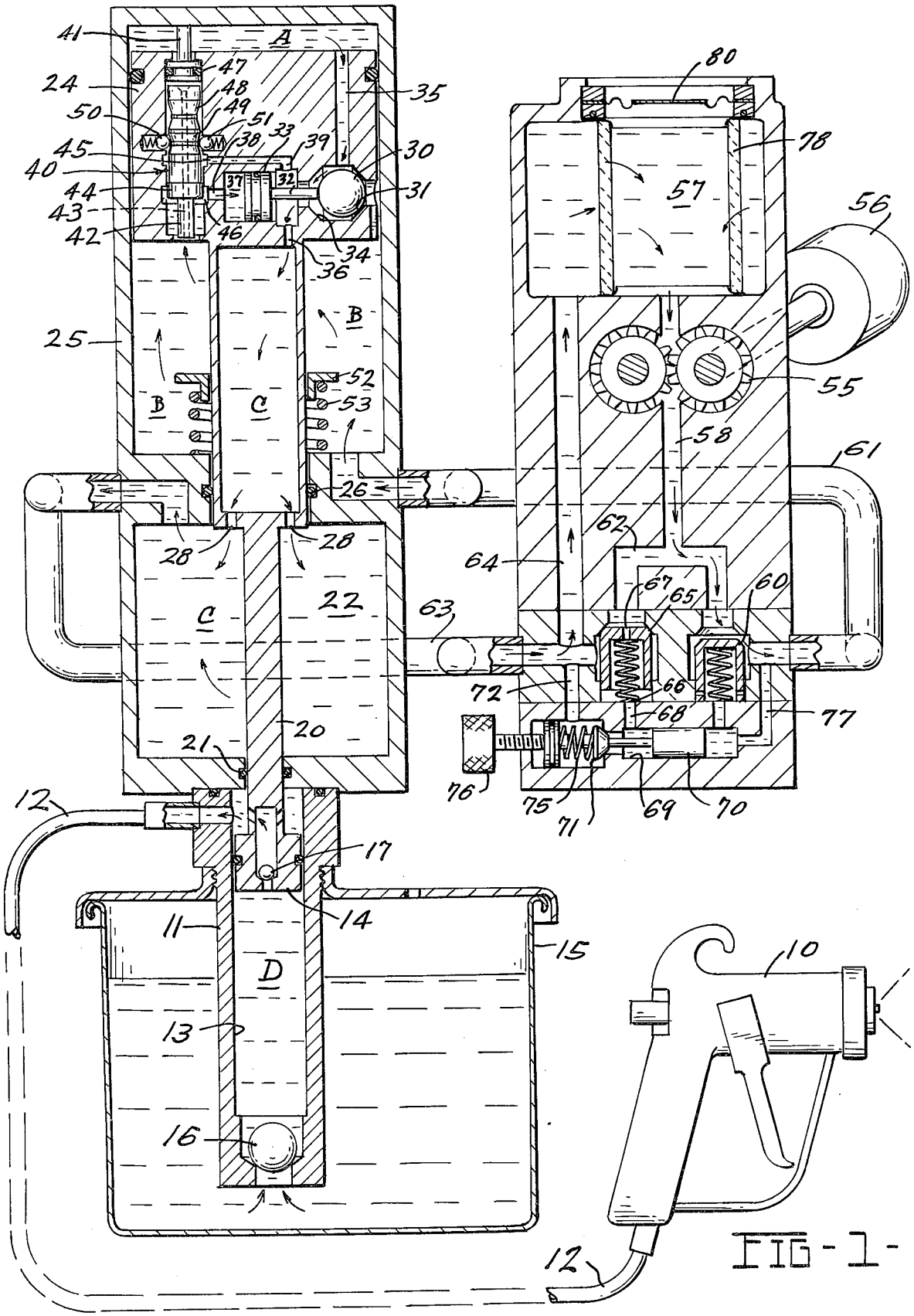
FIG. 1 is a diagrammatic sectional view, with certain parts shown in full line, of a hydraulically operated paint pump constructed in accordance with the present invention.
Figure 2:
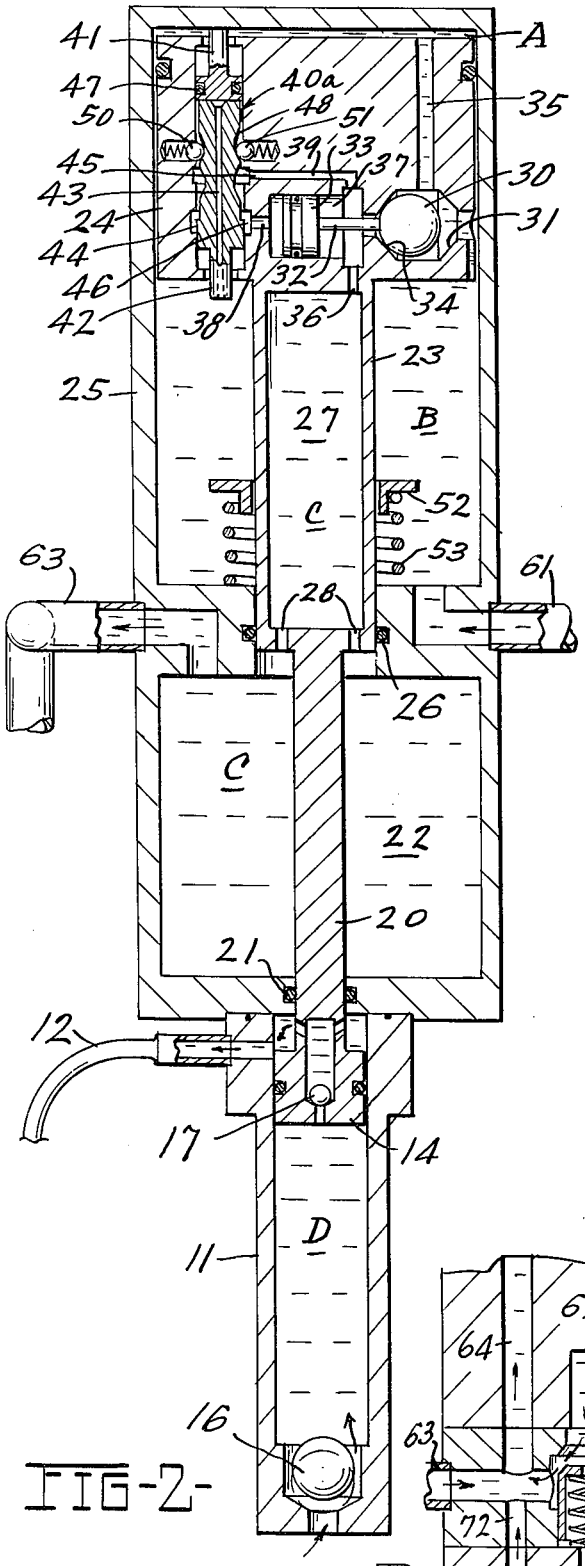
FIG. 2 is a partial central, vertical, sectional view of the pump parts at the end of an upstroke and at the top reversal position.
Figure 3:
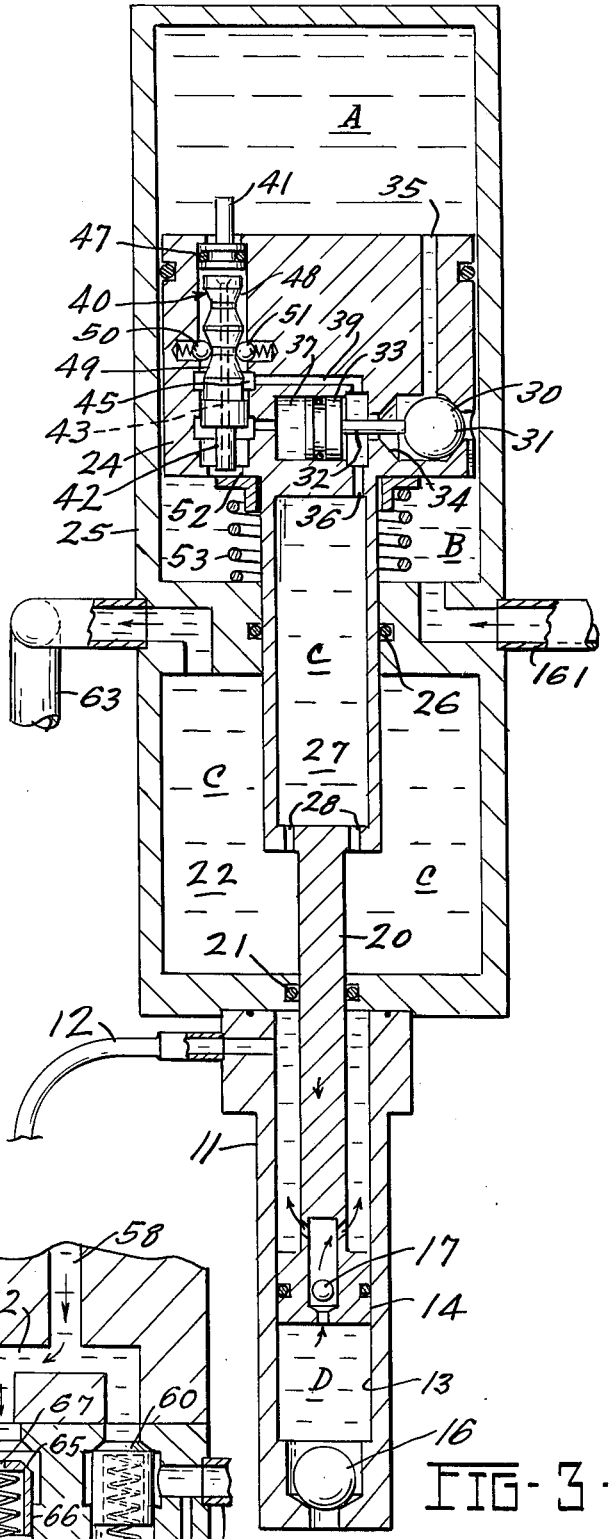
FIG. 3 is a view similar to FIG. 2 with the parts shown at the end of a downstroke and in the bottom reversal position.
Figure 4:
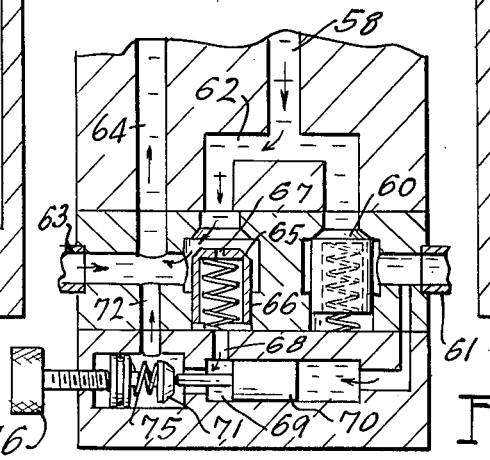
FIG. 4 is a fragmentary view of the unloader valve portion of the apparatus shown in its unloaded position, in contrast to FIG. 1 in which the parts are shown in the loaded, pressure discharging position.

In the preferred embodiment of the invention the pump system is intended to supply paint or coating material to an airless spray gun 10 which requires that the coating material be under a pressure of several hundred, and perhaps as much as 3500 psi. The spray gun 10 is equipped with the conventional trigger which opens and closes a valve in the gun whenever the trigger is pulled by the operator. The system is sized to provide a maximum flow of about 60 or 70 ounces per minute per gun at pressures ranging up to 3500 psi.

The paint pump is designated generally 11 and is connected to the spray gun 10 by a hose 12. The pump 11 is a double-acting reciprocating pump having a cylinder 13 and a piston 14 working therein. The pump may be immersed in a paint container 15 or otherwise connected thereto. At its lower end the cylinder 13 has a conventional foot valve 16 and a traveling valve 17 is provided in the piston 14. On the upstroke of the piston 14, paint is drawn into the cylinder 13 past the foot valve 16. The traveling valve 17 in the piston is closed and paint in the cylinder above the piston is discharged to hose 12 and to the spray gun 10. On the downstroke of the piston 14, the foot valve 16 is closed and the previous charge of paint is forced upwardly past the now-open traveling valve 17. Due to the intrusion of the piston rod the volume of the chamber in the cylinder 13 above the piston is smaller than the volume of the chamber below the piston so that about one-half of the charge from the lower chamber is discharged directly to hose 12 and through the gun while the rests stays in the upper chamber to be discharged on the next upstroke.

The paint pump piston rod is shown at 20. The rod extends upwardly through a seal 21 and through a motor discharge chamber 22 to be connected to a piston rod 23 of a hydraulic motor. A motor piston 24 is reciprocated hydraulically in a motor cylinder 25 and the motor piston 24 divides the cylinder 25 into an upper chamber A and a lower chamber B. A seal 26 is placed between the motor cylinder 25 and the discharge chamber 22 which is at atmospheric pressure. The motor piston rod 23 is made hollow and the interior chamber 27 thus formed is in direct and open communication with motor discharge chamber 22 through ports 28.

Within the motor piston 24 the present invention provides a main reversing valve 30 in the form of a ball valve which in one position is held against a seat 31 by a stem 32 connected to a main valve operating piston 33. In another operating position the valve 30 is held against an opposite seat 34 by hydraulic pressure as will be hereinafter described. The main reversing valve in its first position opens communication between passage 35 to the upper cylinder space A and a discharge passage 36. In its other position, when the valve 30 is against its seat 34, passage 35 is put into communication with the lower cylinder space B by a reduced or fluted section of piston 24 so that the same pressure exists in spaces A and B above and below the motor piston. When the motor is operating the pressures in chamber B and chamber A are balanced on the piston downstroke and are unbalanced on the piston upstroke, chamber A being then at discharge or atmospheric pressure and chamber B being then at operating pressure. A balanced pressure will cause a downstroke of the piston because the effective piston area in chamber A is greater than the effective piston area in chamber B due to the presence of the piston rod 23.

The main valve operating piston 33 is reciprocated in a cylinder 37 and a pressure fluid passage 38 communicates to one end of the cylinder 37 while a second fluid passage 39 communicates with the opposite end. Depending on which side of the piston 33 receives high pressure, the piston will move back and forth to open the main valve 30 or to permit it to close.

A two-position pilot valve 40 is carried by the motor piston 24 and comprises an elongated spool body 40*a* and an upper abutment stem 41 working in the same bore as the spool valve and which protrudes upwardly above the motor piston during an upstroke and a lower abutment stem 42 which protrudes from the lower surface of the piston during a downstroke. The valve spool has a balancing passage 43 communicating with space B and has a land 44 which covers or uncovers ports 45 and 46 to the main valve operating cylinder passages 38 and 39, respectively.

The upper abutment system 41 is sealed intermediate its ends in the bore in which it operates by a seal 47. The spool valve body 40*a* is provided with spaced operating ramp portions 48 and 49 which cooperate with ball detents 50 and 51 to impart a snap action to the valve body during shifting from one position to the other. The ball detents are each spring-backed so that the force against the valve body as the latter starts to move from one position to another is sufficient to force completion of a shifting movement once the detents have reached the apex of the contour and have started down the opposite ramp.

At the upper reversal position of the pilot valve 40, the upper abutment stem contacts the top of the motor cylinder 25 and the valve starts to shift downwardly, shifting being completed by the ramp and detent mechanism. As the motor piston approaches the bottom reversal position the lower abutment stem 42 engages a shift collar 52 carried around the motor piston rod 23, or otherwise disposed in the path of reciprocation of the abutment stem. A spring 53 urges the shift collar 52 upwardly and the collar is moved down by the abutment stem until the spool valve 40 starts to shift to its opposite position. The detents hold the spool valve in position until spring 53 builds up sufficient force to start shifting the spool 40. The spring 53, having a lower rate than the detents, will shift the valve to its uppermost position.

The motor fluid for the motor piston 24 is supplied by a suitable pressure source such as a gear pump 55 driven by a motor 56. The gear pump 55 takes hydraulic fluid from a reservoir 57 and discharges it at high pressure into a discharge line 58 which communicates past a spring pressed check valve 60 with a fluid motor supply line 61 and also communicates with a return bypass line 62 as will be hereinafter described. The main operating motor discharge chamber 22 is placed into communication with the pump reservoir 57 by a return line 63 and a passage 64.

A differential pressure unloading bypass valve 65 is interposed between pump bypass passage 62 and the return passage 64 to the reservoir 57 and to the pump inlet. The unloading bypass valve 65 is a cup-shaped member normally urged against its seat by a spring 66. A small orifice 67 is provided in the head of the valve 65 and the lower part of the cavity in which the valve operates is connected by a passage 68 to a cylinder 69 having a piston 70 therein, which piston has a rod which abuts a control valve 71. When the control valve 71 is opened a connection is established between the bypass passage 62 and a fluid passage 72 which is then in direct communication with the main pump return passage 64. At this time the pressure beneath the bypass valve 65 drops to the pressure of the return passage and the valve snaps quickly to an open position. The orifice 67 will permit a restricted flow of oil from the top to the bottom of the bypass valve and will keep the pressure below the valve at a lesser value than the pressure above it so that, once opened the valve 65 will remain open until the pressures above and below its head are balanced. This occurs when the control valve 71 closes again against its seat as hereinafter described. Thus when bypass valve 65 is open the discharge of the pump is at substantially atmospheric pressure and the pump is unloaded.

Valve 71 which controls the flow from passage 68 to the passage 72 is urged against its seat by a spring 75 which is adjustable in its force by a control knob 76. The valve 71 is moved away from its seat whenever pressure on one side of the piston 70 rises above a predetermined level. The pressure on this side of the control piston reflects the pressure in the discharge passage 61 because a control passage 77 is in direct communication with the discharge passage. A sudden surge in pressure in passage 61 and hence in passage 77 and against piston 70 caused, for example, by a blocking of the system by closing the trigger operated valve of the spring gun 10 results in unloading the pump 55 as above described. A drop in pressure caused by an opening of the spray gun trigger causes valve 71 to seat, and hence causes bypass valve 65 to seat also.

The reservoir 57 is provided with appropriate filters 78 which cleanse the fluid to the inlet of pump 55 and the reservoir is also provided with a diaphragm 80 so that the entire unit may be transported in any position without leakage or spilling the contents of the reservoir.

OPERATION

The full flow mode of fluid to the spray gun 10 exists as long as hydraulic pressure in the outlet line from the pump 55 to the motor cylinder 25 (space B) is less than that required to unseat the adjustable control valve 71 against spring 75. With zero flow through orifice 67 the spring inside the bypass valve 65 maintains the bypass valve 65 closed, blocking the fluid path 62,64 back to the reservoir 57. Check valve 60 in the pump output line 58 opens to allow hydraulic fluid to the outlet 61 and into section B of the motor cylinder 25.

Sections A and B of the motor cylinder 25 are isolated by the motor piston 24 and the top of the motor piston is alternately connected to atmospheric pressure by the main ball valve 30 which in one position connects section A above the motor piston to atmospheric pressure through passages 35 and 36 and in its opposite position connects section A and section B through passage 35 when the main valve ball 30 is away from its seat 31.

DOWNSTROKE

When the two sides of the motor piston are at the same pressure the piston will move downwardly because the area on the top of the piston is larger than the area on the bottom of the piston. Thus fluid forced into the pressure sections B and A of the motor cylinder 25 by the gear pump 55 results in a downward movement of the motor piston. A downward motion of the pump piston 14 causes the foot valve 16 to close and the traveling valve 17 to open delivering fluid to the gun 10 since the capacity of the space above the double-acting pump piston is less than the capacity of the space below the pump piston.

BOTTOM REVERSAL

At the extreme lower position of the motor piston the abutment stem 42 will contact the shift collar 52 and compress the spring 53 until the force of the spring 53 is sufficient to overcome the detent forces created by the balls and springs 50–51 with the ramps of the pilot valve spool 40. The resultant spring force against distance deflected is designed to impart a "snap" action to the pilot valve 40 shifting it to the upper position, isolating port 37 and permitting pressure fluid to enter port 39 and act against the rear of the main valve operating piston 33. This moves the main valve 30 to the right, seating against seat 31 and again isolating chamber B and opening a connection between chamber A above the motor piston and chamber C which is at atmospheric pressure.

UPSTROKE AND TOP REVERSAL

The resultant pressure on the lower face of the motor piston then causes the motor to make an upstroke which continues until the top reversal position is reached at which abutment stem 41 engages the top of the motor cylinder 25 and the reversing mechanism again operates. This causes a corresponding upward motion of the double-acting pump piston 14. Upward motion of the double-acting pump piston 14 causes the lower pump cylinder to fill due to atmospheric pressure acting on the pump fluid and causes a discharge to the gun 10.

At the extreme upper position of the motor piston 24, the upper abutment stem 41 will contact the top of the motor cylinder 25 and will move down in its bore against the spool valve 40 and begin shifting the pilot valve. Detent balls and springs 50 and 51 go "over center" during the shifting operation of the spool and start down the ramp 48, the springs and detent balls developing a positive shifting force and thus transmitting a downward shifting motion to the pilot spool valve 40. As the pilot spool valve 40 reaches its lower position, port 46 is closed to chamber B and opened to chamber C through passage 36 thus relieving fluid pressure behind the main valve operating piston 33. The main ball valve 30 then behaves as a check valve against seat 34 and allows free transmission of fluid between chamber B and chamber A, pressurizing chamber A to the same pressure as chamber B and causing a top reversal of the motor piston. A downstroke then ensues as previously described.

UNLOADING

The reciprocation of the motor piston 24 continues so long as paint is discharged from the gun 10. If the operator closes the trigger-operated valve that is a normal part of the gun no further fluid can be pumped out. Closing the gun valve causes a pressure surge in the motor cylinder 25 which, of course, is immediately reflected in the motor supply line 61 and hence against the face of piston 70 moving the latter to the left in FIG. 1. The full surge or line pressure appears on the face of the piston 70 so that the control valve 71 is moved rapidly and fully away from its seat, connecting passages 68 and 72 which are at atmospheric pressure. At atmospheric pressure appears beneath the bypass valve 65, this valve opens quickly. It is now possible for fluid to flow through orifice 67 and the pressure beneath the bypass valve 65 is reduced so that this valve stays away from its seat and continues to allow direct passage of fluid from the discharge passage 58 of the gear pump 55 through bypass passage 62 back to the inlet passage 64, back to reservoir 57 and thence to the inlet of pump 55. Check valve 60 closes by its spring and no fluid is able to pass to the discharge line 61. The pressure on pump 55 is minimum, reducing the power required to drive it.

No load operation continues so long as the pressure in passage 61 and against piston 70 is enough to unseat the control valve 71. The magnitude of the required pressure is determined by the rates of the pressure on piston 70 and the force of the adjustable spring 75. When the pressure in the pump discharge passage falls, piston 70 will move to the right in FIG. 1, closing valve 71, thus closing valve 65 which is now balanced with no flow through orifice 67. Check valve 60 opens at this time and the discharge from the gear pump 55 is taken to the hydraulic motor cylinder 25 to cause reciprocation of the motor piston 24 and the paint pump as previously described.

In one commercial embodiment of the invention the differential pressure bypass valve 65 is only about 9/16 inch in diameter. The motor piston diameter is approximately 2.75 inches, so that the inertia of the unloading system is very small in comparison to the inertia of the hydraulic motor and paint pump. The inertia of the piston 70 and valve 71 are both also very small so that the unloader system as a whole responds very rapidly to pressure demands of the spray gun 10. For example, the spray gun operator may select a spray cap that will spray 60 ounces of paint a minute in which case unloading is only necessary when the gun is shut off. On the other hand, the operator may select a spray nozzle that will spray only 30 ounces a minute. Under these circumstances the unloading system opens and closes as a frequency necessary to maintain full pressure at the reduced flow at the spray gun 10. In effect, then, the unloader system acts as a metering device capable of maintaining a small or intermediate flow rate to the spray gun 10 without any noticeable pressure fluctuations at the gun or evidence of pulsation of the paint stream which might cause unevenness of spraying. The unloader system may be made responsive to changes in pressure in hose 12 as well as changes in pressure in the discharge line 61 above described.

What I claim is:

1. A system for supplying paint to a spray gun comprising, in combination, a paint pump, a hydraulic motor for actuating said paint pump, a hydraulic pump having a discharge line for supplying liquid to actuate said hydraulic motor, control means for regulating said hydraulic pump output comprising an unloading mechanism responsive to a predetermined pressure in the discharge line between said hydraulic pump and said hydraulic motor to open a bypass passage from said discharge line to the inlet side of said hydraulic pump, said unloading mechanism including a normally closed cup-shaped bypass valve in said bypass passage, said valve having an orifice in its head which, when fluid flows therethrough reduces the pressure beneath said valve and holds the valve in an open position, so long as flow in said bypass passage persists, whereby said hydraulic pump operates at substantially no load so long as said predetermined pressure persists in said discharge line, and means to adjust the predetermined pressure at which said unloading mechanism operates.

2. The combination of elements defined by claim 1 and a control valve in said bypass passage in series with said cup-shaped bypass valve, which control valve opens and closes a passage communicating with said orifice, and means to open said control valve whenever the pressure in said pump discharge passage exceeds a predetermined limit, and means to close said control valve whenever the pressure in said discharge passage falls below said predetermined limit.

3. A supply system for airless paint spray guns in which paint is discharged at an elevated pressure comprising;

a. an airless spray gun, b. a reciprocating paint pump having its discharge connected to said spray gun, c. a hydraulic motor connected to reciprocate said paint pump, 1. said hydraulic motor having a motor cylinder and a motor piston operating therein.

2. means to cause said motor piston to move in one direction when the pressures on its upper and lower faces are balanced and in the opposite direction when the pressure on one face exceeds the pressure on the other face, 3. a two position main reversing valve interposed between the spaces above and below said piston and operable in one position to connect said spaces to the same pressure and in the other position to connect one of said spaces to pressure and the other of said spaces to substantially atmospheric pressure, 4. a pilot valve having a piston connected to cause movement of said main reversing valve from one position to the other, a. means to cause said pilot valve to operate at predetermined points in the upstroke and downstroke of said motor piston, 5. a pressure pump to supply working fluid under pressure to said hydraulic motor, 6. an unloading mechanism interposed in the discharge line between said pressure pump and said hydraulic motor, a. said unloading mechanism being responsive to a higher than a predetermined pressure in said discharge line to open a bypass passage from said pump discharge to the inlet side of said pump whereby said pressure pump operates at substantially no load so long as said predetermined pressure persists in said discharge line and 7. means to adjust the predetermined pressure at which said unloading mechanism operates.

* * * * *